US008887695B2

(12) United States Patent
Aso

(10) Patent No.: US 8,887,695 B2
(45) Date of Patent: Nov. 18, 2014

(54) DEVICE FOR TREATING EVAPORATED FUEL

(75) Inventor: Shuichi Aso, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 712 days.

(21) Appl. No.: 13/201,560

(22) PCT Filed: Feb. 16, 2009

(86) PCT No.: PCT/JP2009/052540

§ 371 (c)(1),
(2), (4) Date: Aug. 15, 2011

(87) PCT Pub. No.: WO2010/092690

PCT Pub. Date: Aug. 19, 2010

(65) Prior Publication Data

US 2011/0297127 A1 Dec. 8, 2011

(51) Int. Cl.

| | |
|---|---|
| ***F02M 33/00*** | (2006.01) |
| ***F02M 33/02*** | (2006.01) |
| ***F02M 33/06*** | (2006.01) |
| ***F02M 25/08*** | (2006.01) |

(52) U.S. Cl.

CPC ..... *F02M 25/089* (2013.01); *F02M 25/0854* (2013.01); *Y10S 903/903* (2013.01); *Y10S 903/904* (2013.01); *Y10S 903/907* (2013.01); *Y10S 903/951* (2013.01)

USPC ..... 123/519; 123/518; 180/68.5; 903/903; 903/904; 903/907; 903/951

(58) Field of Classification Search

CPC ..... F02M 25/089; F02M 25/0854

USPC ..... 123/514, 518, 519; 180/68.5, 65.21, 180/65.22; 903/903, 904, 907, 951

See application file for complete search history.

(56) References Cited

U.S. PATENT DOCUMENTS 5,687,697 A 11/1997 Ishikawa
8,522,912 B2 * 9/2013 Yamada et al. ..... 180/325

(Continued)

FOREIGN PATENT DOCUMENTS

DE 41 40 090 A1 6/1993
GB 2 403 588 A 1/2005

(Continued)

OTHER PUBLICATIONS

Dec. 3, 2010 International Preliminary Report on Patentability issued in International Application No. PCT/JP2009/052540 (with translation).

(Continued)

*Primary Examiner* — Hai Huynh
*Assistant Examiner* — Raza Najmuddin
(74) *Attorney, Agent, or Firm* — Oliff PLC

(57) ABSTRACT

In a vehicle that runs by drive power of a motor in addition to that of an engine, a device for treating evaporated fuel is provided that may heat a canister and improve desorption efficiency even in a state in which there is little exhaust heat from the engine. A vehicle is provided with a first battery and a second battery. A canister is disposed in front of the first battery and below the second battery. Because the canister is disposed near to the batteries, heat is transferred from the batteries to the canister and an adsorbing agent in the canister is heated.

18 Claims, 9 Drawing Sheets

(56) References Cited

U.S. PATENT DOCUMENTS

| | | | | |
|---|---|---|---|---|
| 2006/0086343 | A1 | 4/2006 | Suzuki | |
| 2006/0216560 | A1 | 9/2006 | Voller et al. | |
| 2009/0026802 | A1 | 1/2009 | Imada et al. | |
| 2009/0139783 | A1 | 6/2009 | Menke | |
| 2012/0312281 | A1* | 12/2012 | Tsutsumi et al. | 123/519 |
| 2013/0047568 | A1* | 2/2013 | Yamada et al. | 56/14.7 |

FOREIGN PATENT DOCUMENTS

| | | |
|---|---|---|
| JP | U-63-63571 | 4/1988 |
| JP | A-08-230493 | 9/1996 |
| JP | A-2000-186634 | 7/2000 |
| JP | A-2006-118473 | 5/2006 |
| JP | A-2007-069733 | 3/2007 |
| JP | A-2007-525793 | 9/2007 |
| JP | A-2007-297957 | 11/2007 |
| JP | A-2008-140630 | 6/2008 |
| JP | A-2008-238930 | 10/2008 |
| JP | A-2009-137572 | 6/2009 |

OTHER PUBLICATIONS

Apr. 7, 2009 International Search Report issued in International Application No. PCT/JP2009/052540 (with translation).

Office Action issued in German Application No. 11 2009 004 361.5 dated Jan. 25, 2013 (with translation).

* cited by examiner

DEVICE FOR TREATING EVAPORATED FUEL

TECHNICAL FIELD

The present invention relates to an evaporated fuel treating device for treating evaporated fuel that is produced in a fuel tank.

BACKGROUND ART

A canister adsorbs evaporated fuel from a fuel tank or the like with an adsorbing agent, and an improvement in desorption (purging) efficiency of the adsorbed evaporated fuel is desired. In Patent Reference 1, with regard thereto, a system is recited in which an adsorbing agent in a canister is efficiently heated by the heat of exhaust gas passing through an exhaust pipe of a vehicle, and desorption of the fuel from the adsorbing agent is promoted.

In a hybrid vehicle that runs by appropriately using the drive power of a motor as well as an engine, because of the driving of the motor, driving periods of the engine may be shorter.

However, when the driving periods of the engine are shorter in this manner, exhaust gas does not flow through the exhaust pipe when the engine is stopped. Therefore, heat of the exhaust gas may not be used for heating of the canister when the engine is stopped. Driving the engine just to desorb evaporated fuel would lead to problems such as a deterioration in fuel consumption and the like.

Patent Reference 1: Japanese Patent Application Laid-Open (JP-A) No. 8-230493

DISCLOSURE OF INVENTION

Problem to be Solved by the Invention

In consideration of the situation described above, an object of the present invention is to provide, in a vehicle that runs with drive power of a motor as well as an engine, an evaporated fuel treating device capable of heating a canister and improving desorption efficiency even in a state in which there is little exhaust heat from the engine.

Means for Solving the Problem

In the present invention are included: a fuel tank that is mounted at a vehicle body and in which fuel is accommodated; a rechargeable battery that is mounted at the vehicle body and that charges and discharges electricity; and a canister that is disposed at a location near to the rechargeable battery such that heat is transferred thereto from the rechargeable battery, and that adsorbs evaporated fuel produced in the fuel tank.

That is, in the present invention, the canister that adsorbs the evaporated fuel occurring in the fuel tank is disposed at a location near to the rechargeable battery, and heat from the rechargeable battery is transferred to the canister. Therefore, even in a state in which there is little exhaust heat from the engine, when the engine is stopped or the like, the heat of the rechargeable battery is used to heat the canister, and the desorption efficiency of evaporated fuel may be improved.

In the present invention, the fuel tank may be disposed below a seat of the vehicle, the rechargeable battery may be disposed in a recess portion provided in a floor panel to rearward of the seat, and the canister may be disposed between the fuel tank and the rechargeable battery.

That is, because the rechargeable battery is disposed in the recess portion of the floor panel behind the seat and the canister is disposed between the fuel tank and the rechargeable battery, a structure may be realized in which the canister is inherently disposed close to the rechargeable battery. Moreover, the canister may be disposed to efficiently use a space between the fuel tank and the rechargeable battery. Even disposition of a canister with a large volume is possible.

In the present invention, the term "a location near to the rechargeable battery" is intended to include a range of locations in which desorption efficiency of the canister may be improved by heat of the rechargeable battery being transferred to the canister relative to a configuration in which heat of the rechargeable battery is not transferred thus. For example, the fuel tank and the rechargeable battery may be disposed such that an overlap region is constituted in which the fuel tank and the rechargeable battery overlap with one another if viewed in a vehicle front-rear direction and at least a portion of the canister may be disposed in the overlap region.

That is, in this structure, as illustrated in FIG. 1, the tank T and the rechargeable battery B overlap in region E1 when viewed in the vehicle front-rear direction (the direction of arrow FR and the opposite direction). This overlap region E1 is a location that is closer to the rechargeable battery B than, for example, a region to forward relative to the fuel tank T. Therefore, provided at least a portion of the canister C is disposed in the overlap region E1, this is a structure in which the canister C is inherently disposed at a location near to the rechargeable battery B.

At least a portion of the canister may be disposed behind the fuel tank and below the rechargeable battery.

That is, as illustrated in FIG. 2, a region E3 that is projected rearward in the vehicle (the directly backward direction opposite to arrow FR) from the fuel tank T and a region E4 that is projected downward (the directly downward direction opposite to arrow UP) from the rechargeable battery B intersect at an intersection region E2. If the canister C is disposed at this intersection region E2, this is a structure in which the canister C is inherently disposed at a location near to the rechargeable battery B.

Furthermore, in a configuration in which the fuel tank is disposed below the seat and the rechargeable battery is disposed rearward of the seat, if a structure is formed in which at least a portion of a fuelling fixture of the fuel tank is disposed between the fuel tank and the canister, at a location that is higher than a liquid level of the fuel tank, space between the fuel tank and the canister may be used efficiently and the fuelling fixture may be inherently disposed at a location higher than the fuel liquid level in the fuel tank.

The present invention may further include a pair of side members that are disposed at each of two vehicle width direction outer sides relative to the fuel tank and the rechargeable battery and that structure a frame of the vehicle body, wherein the canister is disposed between the side members.

Thus, because the vehicle width direction outer sides of the rechargeable battery and the canister are encircled by the pair of side members, releases of heat from the rechargeable battery in the vehicle width direction are suppressed, and the canister may be heated efficiently.

The present invention may further include: an exhaust pipe that is disposed at one vehicle width direction outer side relative to the fuel tank and the rechargeable battery and is for exhausting exhaust gas from an engine; and a filler pipe that is disposed at the other vehicle width direction outer side relative to the fuel tank and the rechargeable battery and is for refueling fuel into the fuel tank, wherein the canister is disposed between the exhaust pipe and the filler pipe.

Thus, because the vehicle width direction outer sides of the rechargeable battery and the canister are encircled by the exhaust pipe and the filler pipe, releases of heat from the rechargeable battery in the vehicle width direction are suppressed, and the canister may be heated efficiently.

The present invention may further include a cover member that is attached to the vehicle body and covers the rechargeable battery and the canister from below.

Releases of heat downward from the rechargeable battery are suppressed by this cover member, and the canister may be heated efficiently.

The present invention may further include a cooling fan that blows air toward the rechargeable battery and cools the rechargeable battery, wherein the canister is disposed at a downstream side of the rechargeable battery in a direction of air-blowing from the cooling fan.

The rechargeable battery may be cooled by air-blowing at the rechargeable battery from the cooling fan. Because the canister is disposed at the downstream side in the direction of air-blowing from the cooling fan relative to the rechargeable battery, air whose temperature has been raised by cooling the rechargeable battery is actively blown at the canister. Thus, the canister may be heated efficiently.

In the present invention, if the canister is provided with an atmosphere communication layer at which an adsorbing agent is in fluid communication with the atmosphere and the canister is disposed in an orientation in which this atmosphere communication layer is at an upper side, the atmosphere communication layer, in which it is harder for a negative load to act during desorption, is heated further. Thus, desorption efficiency of this atmosphere communication layer may be improved.

Effects of the Invention

With the configuration described above, the present invention may, in a vehicle that runs with drive power of a motor as well as an engine, heat a canister and improve desorption efficiency even in a state in which there is little exhaust heat from the engine.

BEST MODE FOR CARRYING OUT THE INVENTION

Figure 3:
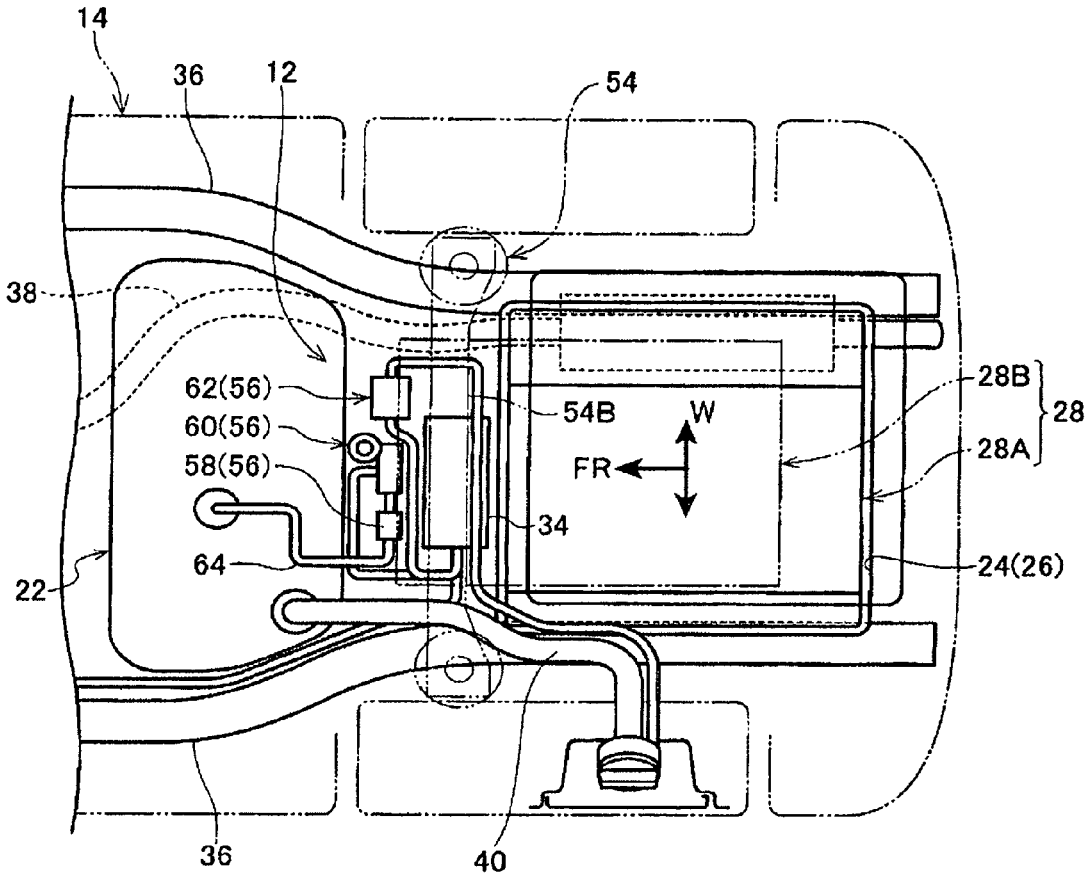
FIG. 3 is a plan diagram of a vehicle rear portion schematically illustrating the evaporated fuel treating device of a first exemplary embodiment of the present invention.
Figure 4:
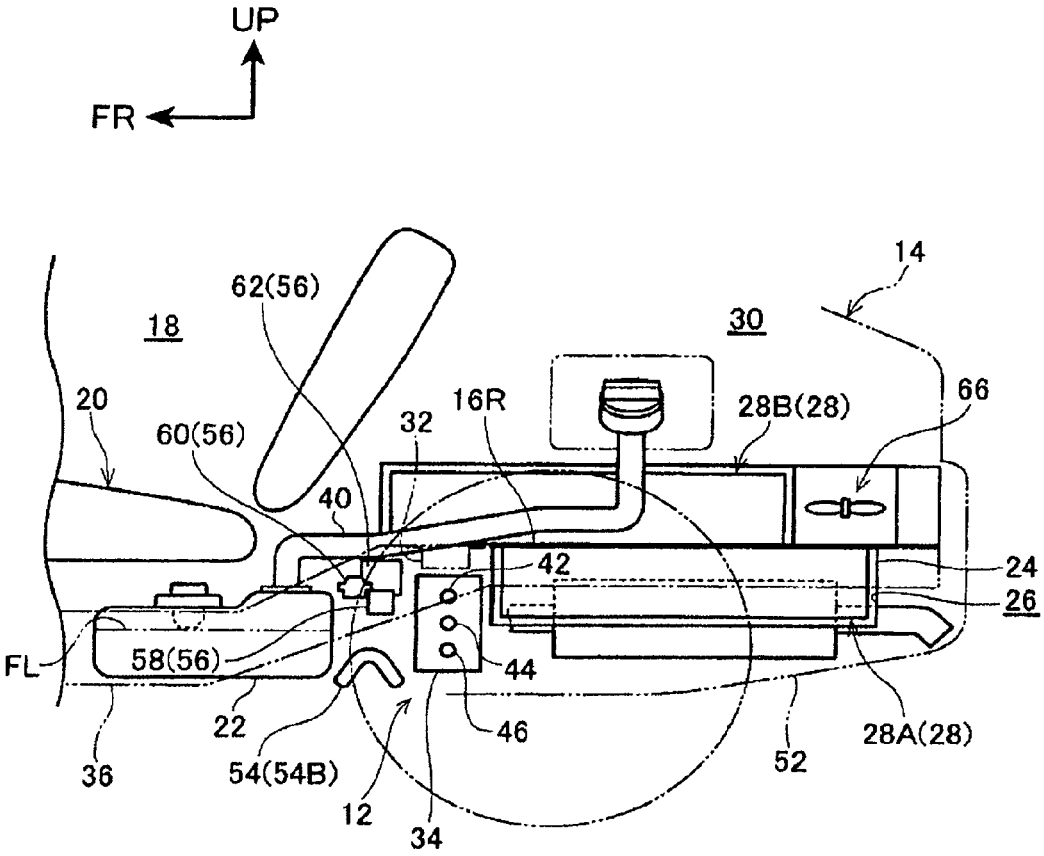
FIG. 4 is a side elevation of the vehicle rear portion schematically illustrating the evaporated fuel treating device of the first exemplary embodiment of the present invention.

FIG. 3 and FIG. 4 schematically illustrate a rear portion of a vehicle 14 in which an evaporated fuel treating device 12 of a first exemplary embodiment of the present invention is deployed. The vehicle 14 is equipped with an engine and a motor (neither of which is illustrated), both of which serve as drive sources of the vehicle 14 and exert drive power.

In these drawings, forward in the vehicle is indicated by the arrow FR, sideward in the vehicle is indicated by the arrow W, and upward is indicated by the arrow UP. The meanings of the terms "forward" and "rearward" when used alone hereinafter are intended to include, respectively, forward in the vehicle and rearward in the vehicle.

The vehicle 14 is provided with a seat 20 mounted inside a cabin 18. Therebelow, a fuel tank 22 is mounted by unillustrated mounting members (tank bands or the like).

A floor pan 24 is provided in a rear floor panel 16R rearward of the seat 20. At the floor pan 24, the rear floor panel 16R is recessed from above to below. The interior of the floor pan 24 serves as an accommodation recess portion 26.

A first battery 28A is accommodated in the accommodation recess portion 26. Front and rear faces, side faces and a bottom face of the first battery 28A are encircled by the floor pan 24. The first battery is charged with electricity for driving the motor. A luggage compartment 30 is formed above the rear floor panel 16R. A space that is for accommodating, for example, a spare tire (a spare tire accommodation portion) may be used as the accommodation recess portion 26 for accommodation of the first battery 28A as described above. In such a case, the spare tire may be taken out from the spare tire accommodation portion and the first battery 28A accommodated therein, or the accommodation recess portion 26 may be structured to be larger such that a gap is formed between inner faces of the spare tire and the floor pan 24 and the first battery 28A accommodated in this gap. In either case, a recess for accommodating a spare tire that is commonly formed in the rear floor panel 16R may be used and there is no need to provide a new recess for accommodation of the first battery 28A, and costs are reduced.

A second battery 28B is disposed on the rear floor panel 16R diagonally forward from the first battery 28A. The second battery 28B is offset to the vehicle forward side relative to the first battery 28A, and protrudes (overhangs) to the forward side from the first battery 28A. This second battery 28B is also charged with electricity for driving the motor. Hereinafter, the first battery 28A and the second battery 28B are collectively referred to where appropriate as a battery 28.

As can be seen from FIG. 4, the rear floor panel 16R is disposed to rearward of the seat 20, and the first battery 28A is at a higher location, than the fuel tank 22.

If viewed in the vehicle front-rear direction, the fuel tank 22 and the first battery 28A partially overlap, and an overlap region E1 (see FIG. 1) is constituted. Furthermore, a region projected rearward in the vehicle from the fuel tank 22 and a region projected downward from the second battery 28B coincide and constitute an intersection region E2 (see FIG. 2).

A cross-member 32 that extends in the vehicle width direction is disposed in front of the first battery 28A and below the second battery 28B. A canister 34 is mounted at the cross-member 32 so as to be disposed below the cross-member 32. That is, the canister 34 is mounted to the vehicle body via the cross-member 32. The canister 34 is disposed to use a space that is formed between the fuel tank 22 and the battery 28. A portion of the canister 34 is disposed in the above-described overlap region E1. Another portion of the canister 34 (which may be the same as or different from the above-mentioned portion) is similarly disposed in the above-described intersection region E2.

In the present exemplary embodiment, as can be seen from FIG. 3 and FIG. 4, because the first battery 28A is disposed in the accommodation recess portion 26 that is provided in the rear floor panel 16R rearward of the seat 20, the first battery 28A is disposed within a predetermined range near to the fuel tank 22. Hence, because the canister 34 is disposed between the fuel tank 22 and the first battery 28A, the canister 34 is inherently disposed near to the first battery 28A.

As illustrated in FIG. 3, a pair of side members 36 are provided at vehicle width direction outer sides of the fuel tank 22 and the battery 28. If the vehicle 14 is seen in plan view, the canister 34 is disposed between these side members 36. That is, the canister 34 is disposed in a region that is encircled by the fuel tank 22, the battery 28 and the side members 36.

Figure 1:
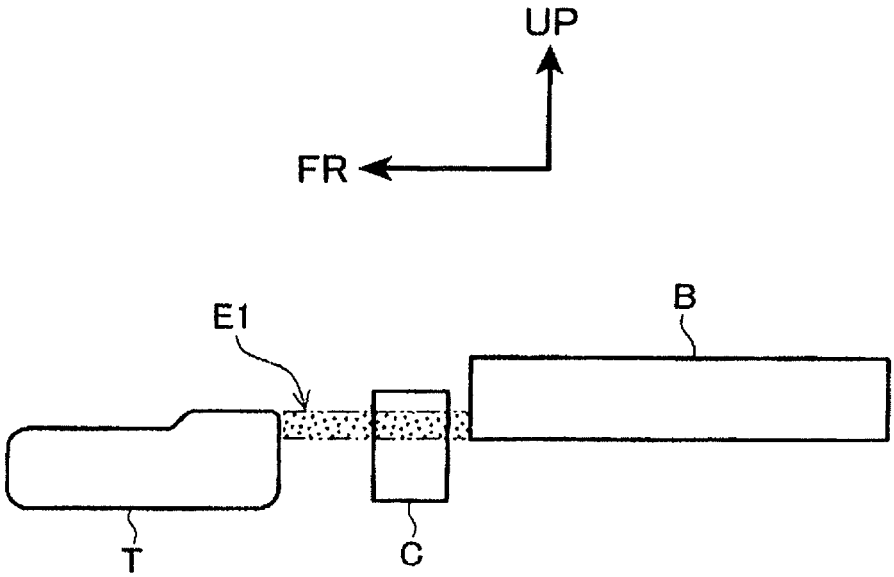
FIG. 1 is a conceptual diagram illustrating a disposition of a canister of an evaporated fuel treating device of the present invention.
Figure 2:
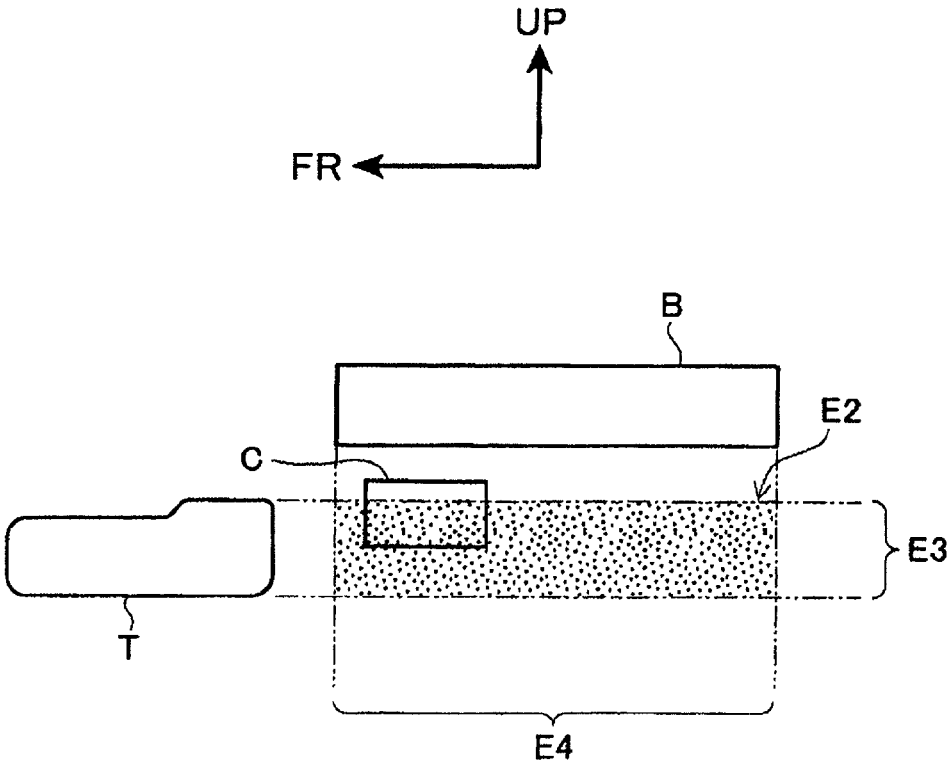
FIG. 2 is a conceptual diagram illustrating a disposition of the canister of the evaporated fuel treating device of the present invention.

As can be seen from FIG. 1, an exhaust pipe 38 for exhausting exhaust gas from the engine to the outside is disposed at one side in the vehicle width direction of the fuel tank 22 and the battery 28 (the vehicle width direction right side in the present exemplary embodiment), and a filler pipe 40 for refilling fuel into the fuel tank 22 is disposed at the other vehicle width direction side (the vehicle width direction left side in the present exemplary embodiment). The canister 34 is disposed between the exhaust pipe 38 and the filler pipe 40. That is, the canister 34 is disposed in a region that is encircled by the fuel tank 22, the battery 28, the exhaust pipe 38 and the filler pipe 40.

As can be seen from FIG. 5, the canister 34 is formed in a substantially rectangular parallelepiped shape. As can be seen from FIG. 3 and FIG. 4, the canister 34 is disposed such that, of the six faces thereof, the two faces with the largest areas are disposed to the front and rear. That is, the faces with the largest areas are disposed so as to oppose the first battery 28A.

Figure 5A:
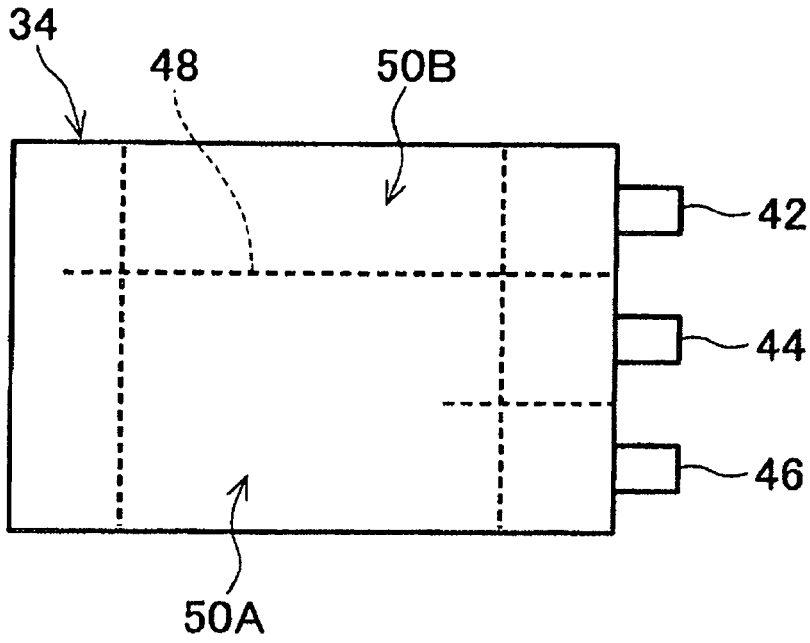
FIG. 5A is a front elevation schematically illustrating a canister that is employed in the evaporated fuel treating device of the first exemplary embodiment of the present invention.
Figure 5B:
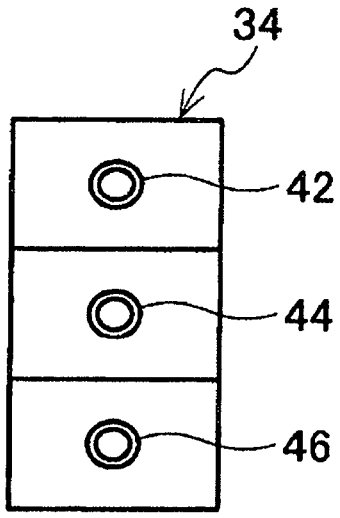
FIG. 5B is a side elevation schematically illustrating the canister that is employed in the evaporated fuel treating device of the first exemplary embodiment of the present invention.

As illustrated in FIG. 5A and FIG. 5B, an atmosphere port 42, a purging port 44 and a tank side port 46 are provided in a side face of the canister 34. An adsorbing agent inside the canister 34 is divided into a first layer 50A at the purging port 44 and the tank side port 46 and a second layer 50B at the atmosphere port 42, by a partition wall 48. During adsorption of evaporated fuel, air containing evaporated fuel that has been produced in the fuel tank is fed into the canister 34 through the tank side port 46, the evaporated fuel is adsorbed by activated carbon while being fed from the first layer into the second layer, and the air is exhausted through the atmosphere port 42. During desorption, atmospheric air is introduced through the atmosphere port 42, desorption is performed while the air is flowing from the second layer 50B to the first layer 50A and, after desorption, the evaporated fuel is sent through the purging port 44 to the engine.

In the present exemplary embodiment, the canister 34 is disposed ("vertically") with, of the three ports, the atmosphere port 42 oriented uppermost, and the second layer 50B is disposed at the upper side relative to the first layer 50A. The evaporated fuel flowing into the canister 34 from the fuel tank 22 has a larger specific gravity than air. Thus, because the atmosphere port 42 and the second layer 50B are disposed at the top, the evaporated fuel is unlikely to rise to the atmosphere port 42, and blowing out of the evaporated fuel may be suppressed.

As illustrated in FIG. 4, a plate-form cover 52 is disposed below the battery 28 and the canister 34. Portions of the cover 52 near to both sides in the vehicle width direction are attached to the side members 36. Thus, the cover 52 is retained in a state of covering the canister 34 and the battery 28 from below.

As illustrated in FIG. 3 and FIG. 4, a middle beam 54B that constitutes a portion of a rear suspension 54 is disposed at a location that is between the fuel tank 22 and the canister 34 in the vehicle front-rear direction. The middle beam 54B extends in the vehicle width direction, and a predetermined gap in the up-down direction is formed between the middle beam 54B and the rear floor panel 16R. An internal pressure sensor 58, a sealing valve 60 and a key-off pump 62 are disposed in a space encircled by the fuel tank 22, the middle beam 54B, the canister 34 and the rear floor panel 16R.

The internal pressure sensor 58 is provided partway along a vapor pipe 64 that communicates between the fuel tank 22 and the canister 34. The internal pressure sensor 58 operates to detect internal pressure of the fuel tank 22. The sealing valve 60 is similarly provided partway along the vapor pipe 64 (at the side of the internal pressure sensor 58 that is closer to the canister 34). The sealing valve 60 operates to open when the internal pressure in the fuel tank 22 is a predetermined high pressure or greater, allowing a portion of the evaporated fuel to migrate to the canister 34, and to maintain a predetermined internal pressure in the fuel tank 22. The key-off pump 62 operates to set predetermined internal pressures in the fuel tank 22 and the canister 34 and detects leakages therein. Herebelow, the internal pressure sensor 58, the sealing valve 60 and the key-off pump 62 are collectively referred to as fuelling fixtures 56. In the present exemplary embodiment, these fuelling fixtures 56 are disposed in the space encircled by the fuel tank 22, the middle beam 5413, the canister 34 and the rear floor panel 16R. Thus, the fuelling fixtures 56 may be disposed at a location higher than a fuel liquid level FL in the fuel tank 22.

As illustrated in FIG. 4, an air-blowing fan 66 is provided at a location behind the second battery and above the first battery. The air-blowing fan 66 blows air from thereabove downward by spinning. A portion of this air flows in the accommodation recess portion 26, forward along the lower face of the first battery 28A from the rear face thereof. As a result, the first battery 28A is cooled and the temperature of the blowing air rises. Hence, the air whose temperature has been raised in this manner reaches a front wall 24F of the floor pan 24. Thus, the front wall 24F and the canister 34 are disposed at the downstream side of the first battery 28A in the direction of air-blowing from the air-blowing fan 66.

Next, operation of the evaporated fuel treating device 12 of the present exemplary embodiment is described.

In the present exemplary embodiment, the canister 34 is disposed to utilize a space formed between the fuel tank 22 and the battery 28. Therefore, the volume of the fuel tank 22, the volume of the battery 28, and volumes of the cabin 18, the luggage compartment 30 and the like may be kept large. Moreover, the volume of the canister 34 may be kept large and the canister 34 mounted to the vehicle body. In, for example, what is known as a plug-in hybrid vehicle, it is preferable for the volume of the battery 28 to be large, and the volume of the canister 34 may be kept large in a plug-in hybrid vehicle.

Compared with a configuration in which the canister 34 is disposed outside the above-mentioned space, various pipes (the vapor pipe 64 and the like) that communicate between the fuel tank 22 and the canister 34 may be shortened, and reductions in cost and weight may be promoted.

During adsorption of evaporated fuel, air containing the evaporated fuel from in the fuel tank 22 is introduced through the tank side port 46 into the canister 34 and adsorbed by the adsorbing agent in the canister 34. During desorption (purging) of the evaporated fuel in the canister 34, atmospheric air is introduced through the atmosphere port 42, and desorbed evaporated fuel is sent through the purging port 44 to the engine.

When the battery 28 is being charged or discharged (current is flowing in or out), the temperature of the surroundings of the battery 28 rises in association with heating in the battery 28. In the present exemplary embodiment, the canister 34 is disposed near to the battery 28 such that a portion of the canister 34 is disposed in the overlap region E1 and another portion is disposed in the intersection region E2. Therefore, heat is transferred from the battery 28 to the canister 34, and the adsorbing agent in the canister 34 may be heated. Hence, in the state in which the adsorbing agent is heated thus, a negative pressure from the engine is caused to act in the canister and desorption is implemented. Therefore, desorption is promoted compared to a case in which the adsorbing agent is not heated, and desorption efficiency is improved. For example, compared with a configuration in which the engine is driven to heat the adsorbing agent in the canister 34 (the heat of exhaust gas is caused to act on the canister 34 via an exhaust pipe during engine driving), effective driving periods of the engine may be shortened (and more preferably reduced to zero), and fuel consumption may be improved.

Moreover, in the present exemplary embodiment, the air-blowing fan 66 may be spun and the battery 28 cooled by air-blowing, and the blowing air is blown along the front wall 24F of the floor pan 24 to the canister 34. Thus, heat of the battery 28 may be actively caused to act on the canister 34, and the adsorbing agent in the canister 34 may be efficiently heated. Therefore, heating efficiency of the canister 34 may be raised and hence desorption efficiency may be raised.

In the present exemplary embodiment, the canister 34 is disposed between the pair of side members 36 that are provided at the vehicle width direction outer sides of the fuel tank 22 and the battery 28, and the canister 34 is encircled by the fuel tank 22, the battery 28 and the side members 36. Therefore, air near to the canister 34 (which has been heated by the battery 28) is prevented from flowing out to the vehicle width direction outer sides (left and right) by the side members 36, and heating efficiency of the adsorbing agent in the canister 34 may be further improved.

Similarly, in the present exemplary embodiment, the canister 34 is disposed between the exhaust pipe 38, which is disposed at one side in the vehicle width direction relative to the fuel tank 22 and the battery 28, and the filler pipe 40, which is disposed at the other side. Thus, the canister 34 is disposed in a region that is encircled by the fuel tank 22, the battery 28, the exhaust pipe 38 and the filler pipe 40. Therefore, heated air near to the canister 34 is prevented from flowing toward the outer sides in the vehicle width direction (left and right) by the exhaust pipe 38 and the filler pipe 40, and heating efficiency of the adsorbing agent in the canister 34 may be yet further improved.

Additionally, in the present exemplary embodiment, the battery 28 and the canister 34 are covered from below by the cover 52 that is disposed therebelow. Therefore, heated air near to the canister 34 is prevented from flowing out to the lower side by the cover 52, and heating efficiency of the adsorbing agent in the canister 34 may be still further improved.

In the present exemplary embodiment, as can be seen from FIG. 3 and FIG. 4, the substantially rectangular parallelepiped canister 34 is disposed in an orientation in which the faces thereof with the largest areas oppose the first battery 28A. Therefore, in comparison with a configuration in which the canister 34 is disposed with a different orientation, an area that receives the heat of air near to the first battery 28A and radiant heat from the first battery 28A is widened. Consequently, heating efficiency of the adsorbing agent in the canister 34 may be improved and desorption efficiency may be improved.

As can be seen from FIG. 4, in the canister 34, the second layer 50B that is in fluid communication with the atmosphere port 42 is at a location at the upper side relative to the first layer 50A, that is, a location closer to the battery 28 than the first layer 50A, and is disposed at the top. Thus, the second layer 50B more easily receives heat from the battery 28. Although the second layer 50B is more resistant than the first layer 50A to the action of a desorption negative load during desorption of the evaporated fuel, because the second layer 50B is more efficiently heated than the first layer 50A, desorption efficiency of the adsorbing agent at the second layer 50B improves and blowing out of the evaporated fuel may be suppressed.

In the present exemplary embodiment, the canister 34 is mounted to the cross-member 32 that extends in the vehicle width direction. Thus, while an improvement in strength of the vehicle body is promoted by the cross-member 32, the canister 34 may be disposed to be brought close to the first battery 28A. Because the canister 34 is disposed to be brought close to the first battery 28A, heating efficiency of the adsorbing agent may be further improved and desorption efficiency may be improved.

In the present exemplary embodiment, the fuelling fixtures 56 are disposed in the region encircled by the fuel tank 22, the middle beam 54B, the canister 34 and the rear floor panel 16R. Thus, the fuelling fixtures 56 are disposed at locations higher than the fuel liquid level FL in the fuel tank 22. Therefore, submersion of the internal pressure sensor 58 (the internal pressure sensor 58 being at a location that is lower than the fuel liquid level FL in the fuel tank 22) is prevented, and the accuracy of internal pressure detection may be kept high. Submersion of the sealing valve 60 too may be prevented. Thus, inappropriate passage of the fuel when the sealing valve 60 is open and deterioration of the adsorbing agent due to the fuel flowing into the canister 34 may be prevented.

Moreover, because the internal pressure sensor 58 and the sealing valve 60 are disposed in the region described above, compared with a configuration in which the same are disposed in another region, the internal pressure sensor 58 and sealing valve 60 are disposed near to the fuel tank 22 and the canister 34. As a result, the length of the vapor pipe 64 may be shortened, and thus reductions in costs and weight may be promoted.

In the present exemplary embodiment, the key-off pump 62 is also disposed in this region. Therefore, in comparison with a configuration in which the key-off pump 62 is disposed at a location close to the interior of the cabin 18 or the interior of the luggage compartment 30, these spaces are not sacrificed and the cabin 18 and the luggage compartment 30 may be kept large.

Members other than the aforementioned internal pressure sensor 58, sealing valve 60 and key-off pump 62 may be disposed in this region, and thus the cabin 18 and the luggage compartment 30 may further be kept large.

Figure 6:
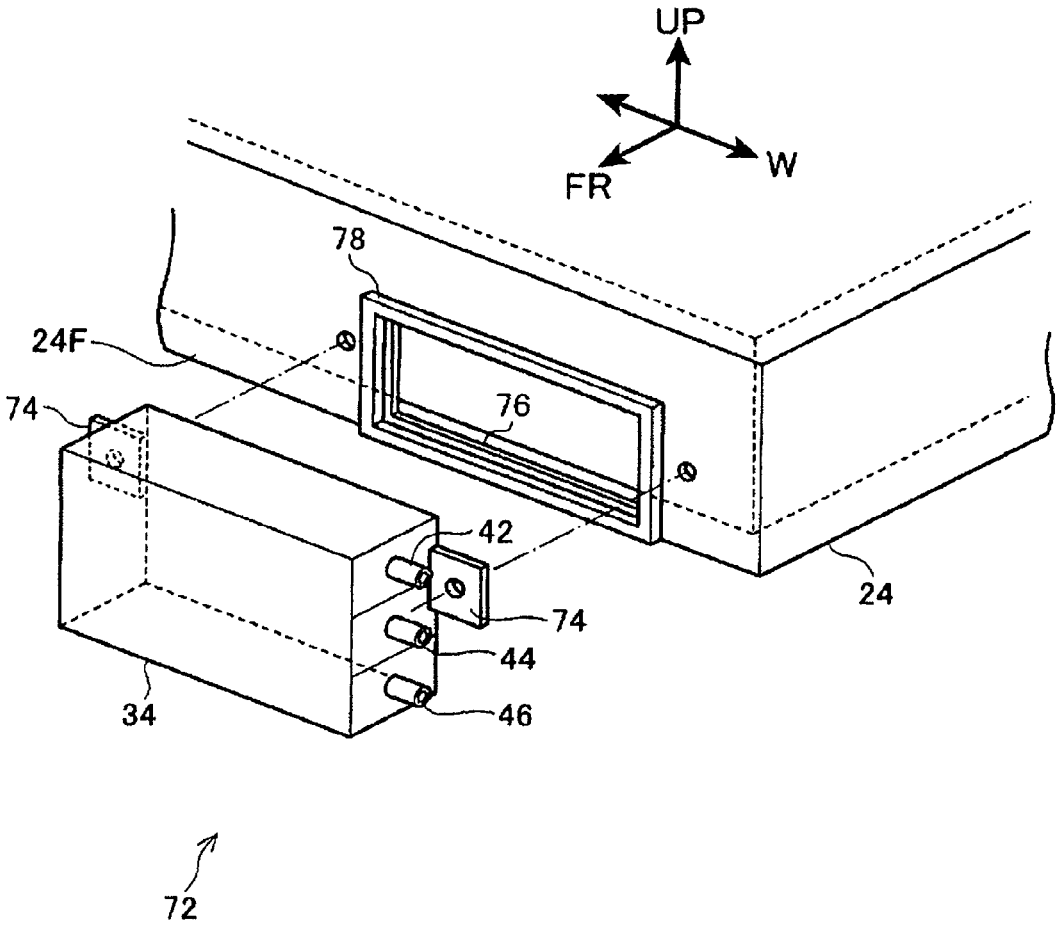
FIG. 6 is a magnified perspective diagram partially illustrating an evaporated fuel treating device of a second exemplary embodiment of the present invention.
Figure 7:
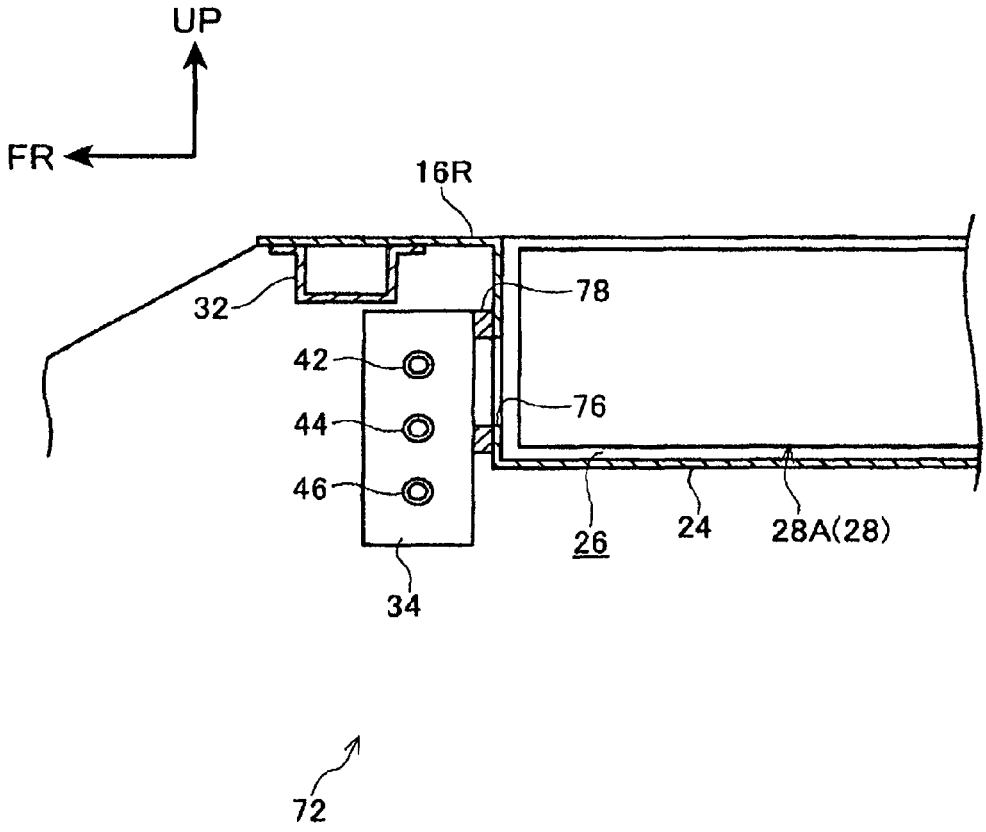
FIG. 7 is a magnified, partial cutaway side elevation partially illustrating the evaporated fuel treating device of the second exemplary embodiment of the present invention.

FIG. 6 and FIG. 7 illustrate an evaporated fuel treating device 72 of a second exemplary embodiment of the present invention, partially magnified. In the second exemplary embodiment, general structures of the vehicle rearward portion are the same as in the first exemplary embodiment, so are not illustrated. In the exemplary embodiments here and hereebelow, structural elements, members and the like that are the same as in the first exemplary embodiment are assigned the same reference numerals and are not described in detail.

In the second exemplary embodiment, differently from the first exemplary embodiment, the canister 34 is mounted to a front face of the front wall 24F of the floor pan 24. A pair of mounting brackets 74 that are turned outward in the width direction extend from the canister 34 and are fixed to the front wall 24F by fastening members such as bolts, rivets or the like.

A penetrating hole 76 is formed at a location of the front wall 24F that opposes the canister 34. Air that is blown from the air-blowing fan 66 and used for cooling of the first battery 28A passes through the penetrating hole 76 and comes into contact with the canister 34. Surroundings of the penetrating hole 76 are reinforced by a reinforcement frame 78.

In the evaporated fuel treating device 72 of the second exemplary embodiment with this configuration, compared with the evaporated fuel treating device 12 of the first exemplary embodiment, the canister 34 is disposed at a location closer to the first battery 28A. Therefore, the adsorbing agent in the canister 34 may be more efficiently heated than in the first exemplary embodiment. Moreover, because blowing air from the air-blowing fan 66 is raised in temperature by the battery 28, passes through the penetrating hole 76 and comes into contact with the canister 34, compared with a configuration in which this blowing air does not come into contact with the canister 34, the adsorbing agent in the canister 34 has a higher heating efficiency.

Figure 8:
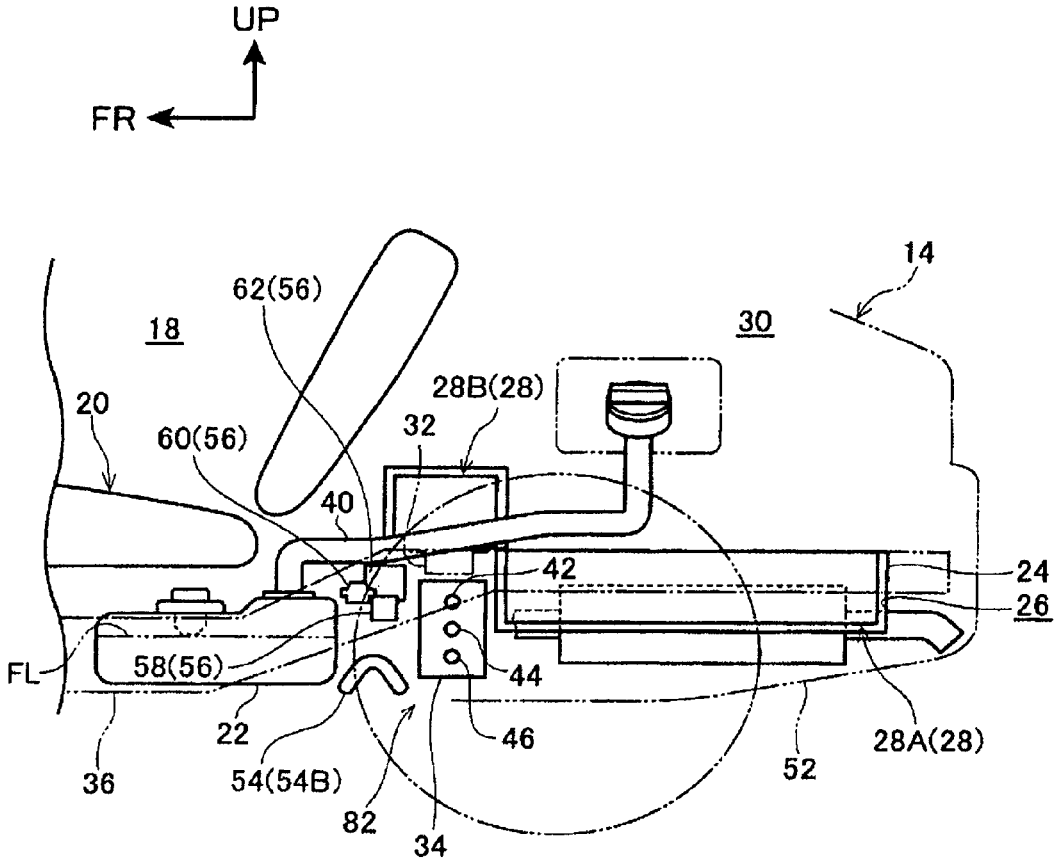
FIG. 8 is a side elevation of a vehicle rear portion schematically illustrating an evaporated fuel treating device of a third exemplary embodiment of the present invention.

FIG. 8 illustrates an evaporated fuel treating device 82 of the third exemplary embodiment of the present invention. In the third exemplary embodiment, a battery whose length in the vehicle front-rear direction is shorter than that of the second battery 28B of the first exemplary embodiment is used as the second battery 28B. The second battery 28B is disposed to the forward side, that is, closer to the seat 20, and the whole of the second battery 28B overhangs to the vehicle forward side relative to the first battery 28A.

Therefore, in the second exemplary embodiment, in addition to the operations and effects of the first exemplary embodiment, the luggage compartment 30 may be kept large in accordance with the reduction in size of the second battery 28B. Below the second battery 28B, the space between the fuel tank 22 and the battery 28 (the first battery 28A) is maintained, and the canister 34 is disposed therein.

Figure 9:
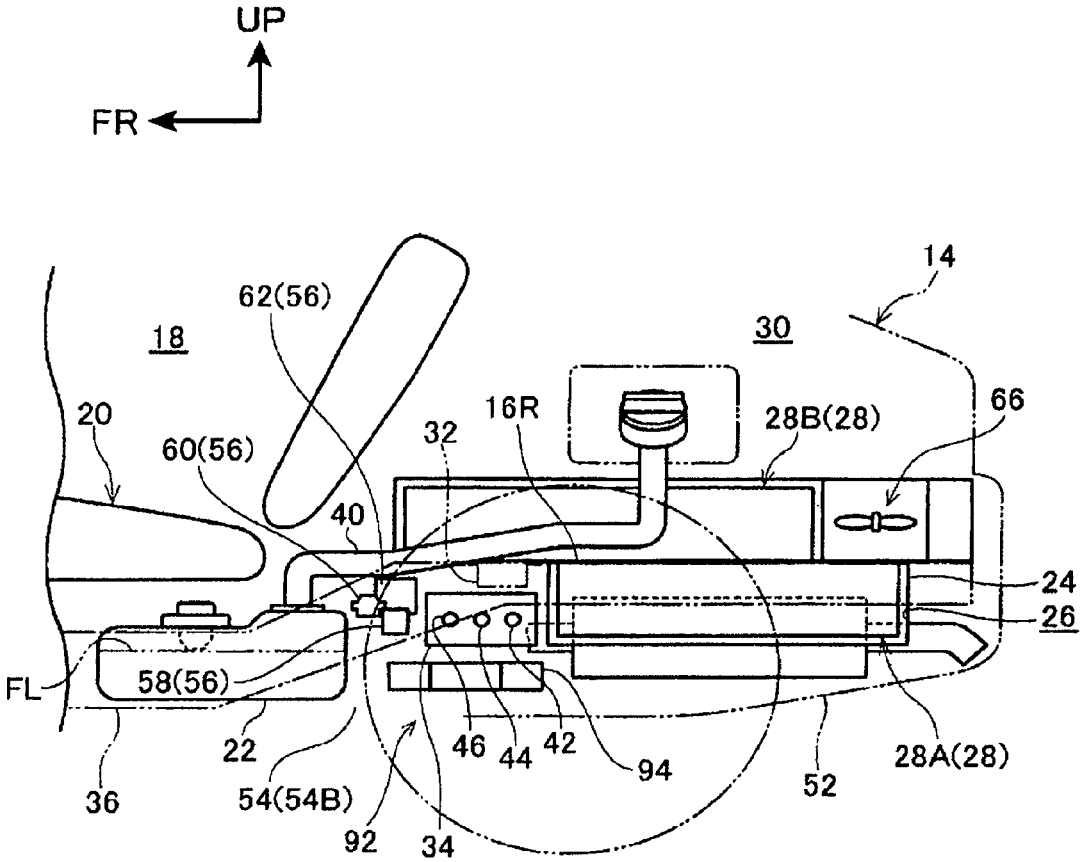
FIG. 9 is a side elevation of a vehicle rear portion schematically illustrating an evaporated fuel treating device of a fourth exemplary embodiment of the present invention.

FIG. 9 illustrates an evaporated fuel treating device 92 of a fourth exemplary embodiment of the present invention. In the third exemplary embodiment, a battery whose length in the vehicle front-rear direction is shorter than that of the first battery 28A of the first exemplary embodiment is used as the first battery 28A. The first battery 28A is disposed to the vehicle rearward side, and the space between the fuel tank 22 and the first battery 28A is widened in the vehicle front-rear direction compared to the first exemplary embodiment. In the fourth exemplary embodiment, the canister 34 is disposed "horizontally" in this space such that the tank side port 46, the purging port 44 and the atmosphere port 42 are in line, in this order, from the vehicle forward side, and the canister 34 is mounted to the cross-member 32.

A suspension member 94 that constitutes the rear suspension is disposed below the canister 34. Compared to the middle beam 54B of the first exemplary embodiment, this suspension member 94 is flatter in the up-down direction and longer in the vehicle front-rear direction.

That is, the fourth exemplary embodiment is an example in which, even when a member with a predetermined length in the vehicle front-rear direction (the suspension member 94 in the example described above) is disposed close to the canister 34, disposition of the canister 34 between the fuel tank 22 and the first battery 28A is possible, because the first battery 28A that is short in the vehicle front-rear direction is used. That is, because the first battery 28A that is short in the vehicle front-rear direction is used, a degree of freedom of arrangement of members in the vicinity around the canister 34 is raised.

In the third exemplary embodiment, the second layer 50B of the adsorbing agent in the canister 34 (see FIG. 5A) and the atmosphere port 42 are not disposed to the upper side. Otherwise, the same operations and effects are realized as in the first exemplary embodiment.

In the third exemplary embodiment and the fourth exemplary embodiment, a mounting structure of the canister 34 that is the same as in the second exemplary embodiment (mounting to the floor pan 24) may be employed.

Hereabove, an example is given in which the battery 28 that exerts drive power of the vehicle is structured by two batteries, the first battery 28A and the second battery 28B, but structures of the battery 28 are not limited thus. For example, either one of the first battery 28A and the second battery 28B may be used alone. In such a case, provided the canister 34 is disposed in the same manner as in FIG. 1 or FIG. 2, heating efficiency of the adsorbing agent may be raised. The present invention may also be applied to a vehicle with three or more batteries. Applications of the battery/ies are not limited to driving of vehicles; other applications are possible.

The invention claimed is:

1. A device for treating evaporated fuel, comprising:

a fuel tank that is mounted at a vehicle body and in which fuel is accommodated;

a rechargeable battery that is mounted at the vehicle body and that charges and discharges electricity; and a canister that, at least a portion thereof being disposed in a region of intersection between a region projected rearward in the vehicle body from the fuel tank and a region projected downward from the rechargeable battery, is disposed at a location near to the rechargeable battery such that heat is transferred thereto from the rechargeable battery, and that adsorbs evaporated fuel produced in the fuel tank.

2. The device for treating evaporated fuel according to claim 1, wherein the fuel tank is disposed below a seat of the vehicle, the rechargeable battery is disposed in a recess portion provided in a floor panel rearward of the seat, and the canister is disposed between the fuel tank and the rechargeable battery.

3. The device for treating evaporated fuel according to claim 1, wherein the fuel tank and the rechargeable battery are disposed such that an overlap region is constituted in which the fuel tank and the rechargeable battery overlap with one another if viewed in a vehicle front-rear direction, and at least a portion of the canister is disposed in the overlap region.

4. The device for treating evaporated fuel according to claim 1, wherein at least a portion of a fuelling fixture of the fuel tank is disposed between the fuel tank and the canister, at a location that is higher than a liquid level of the fuel tank.

5. The device for treating evaporated fuel according to claim 1, further comprising a pair of side members that are disposed at each of two vehicle width direction outer sides relative to the fuel tank and the rechargeable battery and that structure a frame of the vehicle body, wherein the canister is disposed between the side members.

6. The device for treating evaporated fuel according to claim 1, further comprising:

an exhaust pipe that is disposed at one vehicle width direction outer side relative to the fuel tank and the rechargeable battery and is for exhausting exhaust gas from an engine; and a filler pipe that is disposed at the other vehicle width direction outer side relative to the fuel tank and the rechargeable battery and is for refueling fuel into the fuel tank, wherein the canister is disposed between the exhaust pipe and the filler pipe.

7. The device for treating evaporated fuel according to claim 1, further comprising a cover member that is attached to the vehicle body and covers the rechargeable battery and the canister from below.

8. The device for treating evaporated fuel according to claim 1, further comprising a cooling fan that blows air toward the rechargeable battery and cools the rechargeable battery, wherein the canister is disposed at a downstream side of the rechargeable battery in a direction of air-blowing from the cooling fan.

9. The device for treating evaporated fuel according to claim 1, wherein the canister is provided with an atmosphere communication layer at which an adsorbing agent is in fluid communication with the atmosphere, and the canister is disposed in an orientation in which this atmosphere communication layer is at an upper side.

10. A device for treating evaporated fuel, comprising:

a fuel tank that is mounted at a vehicle body and in which fuel is accommodated;

a rechargeable battery that is mounted at the vehicle body and that charges and discharges electricity; and a canister that, at least a portion thereof being disposed in a region of intersection between a region projected rearward in the vehicle body from the fuel tank and a region projected downward from the rechargeable battery, is disposed at a location near to the rechargeable battery such that heat is transferred thereto from the rechargeable battery, and that adsorbs evaporated fuel produced in the fuel tank, wherein the fuel tank is disposed below a seat of the vehicle, the rechargeable battery is disposed in a recess portion provided in a floor panel rearward of the seat, the canister is disposed between the fuel tank and the rechargeable battery, the fuel tank and the rechargeable battery are disposed such that an overlap region is constituted in which the fuel tank and the rechargeable battery overlap with one another if viewed in a vehicle front-rear direction, and at least a portion of the canister is disposed in the overlap region.

11. The device for treating evaporated fuel according to claim 10, wherein at least a portion of a fuelling fixture of the fuel tank is disposed between the fuel tank and the canister, at a location that is higher than a liquid level of the fuel tank.

12. The device for treating evaporated fuel according to claim 10, further comprising a pair of side members that are disposed at each of two vehicle width direction outer sides relative to the fuel tank and the rechargeable battery and that structure a frame of the vehicle body, wherein the canister is disposed between the side members.

13. The device for treating evaporated fuel according to claim 10, further comprising:

an exhaust pipe that is disposed at one vehicle width direction outer side relative to the fuel tank and the rechargeable battery and is for exhausting exhaust gas from an engine; and a filler pipe that is disposed at the other vehicle width direction outer side relative to the fuel tank and the rechargeable battery and is for refueling fuel into the fuel tank, wherein the canister is disposed between the exhaust pipe and the filler pipe.

14. The device for treating evaporated fuel according to claim 10, further comprising a cover member that is attached to the vehicle body and covers the rechargeable battery and the canister from below.

15. The device for treating evaporated fuel according to claim 10, further comprising a cooling fan that blows air toward the rechargeable battery and cools the rechargeable battery, wherein the canister is disposed at a downstream side of the rechargeable battery in a direction of air-blowing from the cooling fan.

16. The device for treating evaporated fuel according to claim 10, wherein the canister is provided with an atmosphere communication layer at which an adsorbing agent is in fluid communication with the atmosphere, and the canister is disposed in an orientation in which this atmosphere communication layer is at an upper side.

17. The device for treating evaporated fuel according to claim 7, further comprising a cooling fan that blows air toward the rechargeable battery and cools the rechargeable battery, wherein the canister is disposed at a downstream side of the rechargeable battery in a direction of air-blowing from the cooling fan.

18. The device for treating evaporated fuel according to claim 7, wherein the canister is provided with an atmosphere communication layer at which an adsorbing agent is in fluid communication with the atmosphere, and the canister is disposed in an orientation in which this atmosphere communication layer is at an upper side.

* * * * *